US007524125B2

(12) United States Patent
Lambert

(10) Patent No.: US 7,524,125 B2
(45) Date of Patent: Apr. 28, 2009

(54) LIQUID SOAP DISPENSING AND SCRUBBING TOOL

(76) Inventor: Hubert L. Lambert, 3512 Arcadia St., Apt. A, Norfolk, VA (US) 23502

( * ) Notice: Subject to any disclaimer, the term of this patent is extended or adjusted under 35 U.S.C. 154(b) by 65 days.

(21) Appl. No.: 11/808,014

(22) Filed: Jun. 6, 2007

(65) Prior Publication Data

US 2008/0304899 A1 Dec. 11, 2008

(51) Int. Cl.
*B43M 11/06* (2006.01)
*A46B 5/02* (2006.01)

(52) U.S. Cl. ..... 401/207; 401/205; 401/8

(58) Field of Classification Search ..... 401/8, 401/200, 207, 291, 203, 204, 205; 215/396–398; D7/533–536

See application file for complete search history.

(56) References Cited

U.S. PATENT DOCUMENTS 2,095,423 A * 10/1937 Tilley ..... 401/207
5,114,255 A * 5/1992 Villarreal ..... 401/45
6,315,481 B1 * 11/2001 Gavorski et al. ..... 401/150
D535,882 S 1/2007 Lambert

* cited by examiner

*Primary Examiner*—David J Walczak
(74) *Attorney, Agent, or Firm*—Stephen R. Greiner

(57) ABSTRACT

A liquid soap dispensing and scrubbing tool including an open-topped container for holding a predetermined quantity of liquid soap solution. The container has a circular bottom wall and a cylindrical, side wall that is connected to, and extends upwardly from, the circular bottom wall. The cylindrical, side wall is provided with external, helical threads at its top and a pair of vertically aligned openings. A C-shaped, tubular handle is connected to the first, cylindrical, side wall such that it places the pair of vertically aligned openings in fluid communication with one another. A lid is removably fastened to the top of the container. The lid has a circular, top wall with a number of spaced-apart openings for the passage of liquid soap solution from the container. A second, cylindrical, side wall is connected to, and extends downwardly from, the top wall. The second, cylindrical, side wall is provided with internal, helical threads adapted to screw onto the external, helical threads of the container. A sponge is affixed atop the top wall of the lid so as to cover all of the openings in the top wall.

1 Claim, 2 Drawing Sheets

LIQUID SOAP DISPENSING AND SCRUBBING TOOL

FIELD OF THE INVENTION

The present invention relates generally to coating implements with material supply means and, more particularly, to such implements where material flows through a porous tool.

BACKGROUND OF THE INVENTION

Washing a car is never easy. Typically, filling a bucket with soapy water starts the process. Then, a wash cloth carrying soapy water from the bucket is wiped over a small area of the car, say, the hood. Simultaneously, dirt loosened by the wiping action of the wash cloth is hosed off the hood. Next, the wash cloth is rinsed in the bucket and another area of the car is wiped. Wiping, hosing, and rinsing continue until the car is clean.

Some find the repeated rinsing of a wash cloth in ever dirtier water unappealing. This water, of course, contains germs that can cause illness. Beyond that, the dirt particles suspended in the water serve as an abrasive that can damage the finish of the car being wiped by a wash cloth saturated with the material.

Tools have been proposed for the "touchless" washing of cars. These tools usually jet a stream of liquid under high pressure at a car to loosen dirt. Unfortunately, these tools are impractical for use around a home since they are expensive to purchase and operate.

SUMMARY OF THE INVENTION

In light of the problems associated with the known tools and methods for washing cars, it is a principal object of the invention to provide a liquid soap dispensing and scrubbing tool that is able to dislodge, by contact, dirt from a car and rinse itself to flush away particulate matter so as to prevent damage to a car being washed. Rinsing is automatically accomplished with a liquid soap solution that lifts dirt from the car when the tool is in contact therewith.

It is another object of the invention to provide a liquid soap dispensing and scrubbing tool of the type described that is easy to hold and manipulate during use in washing a car.

It is a further object of the invention to provide a tool of the type described that can be used without resort to other tools or prolonged periods of training. The tool, it is believed, is intuitive to use.

It is an object of the invention to provide improved features and arrangements thereof in a liquid soap dispensing and scrubbing tool for the purposes described that is lightweight in construction, inexpensive to manufacture, and fully dependable in use.

The foregoing and other objects, features, and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION

Figure 1:
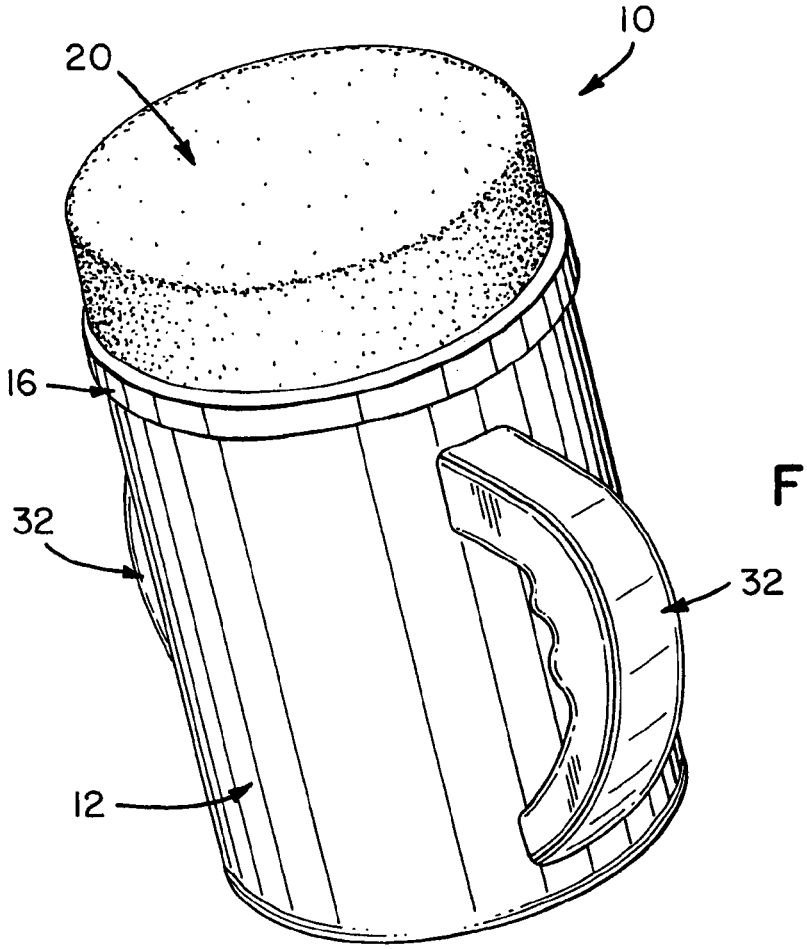
FIG. 1 is a perspective view of a liquid soap dispensing and scrubbing tool in accordance with the present invention.
Figure 2:
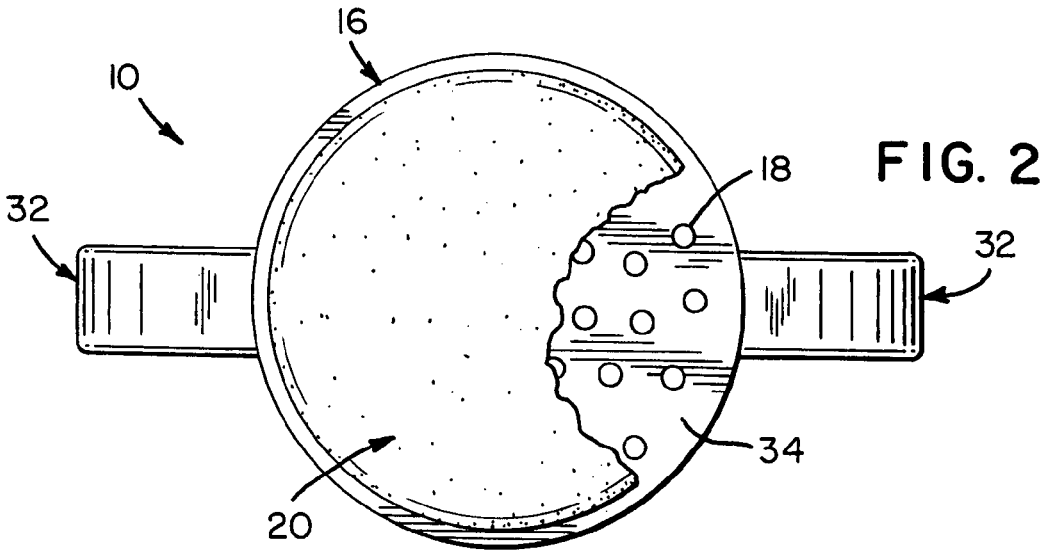
FIG. 2 is a top view of the tool of FIG. 1 with portions broken away to reveal details thereof.
Figure 3:
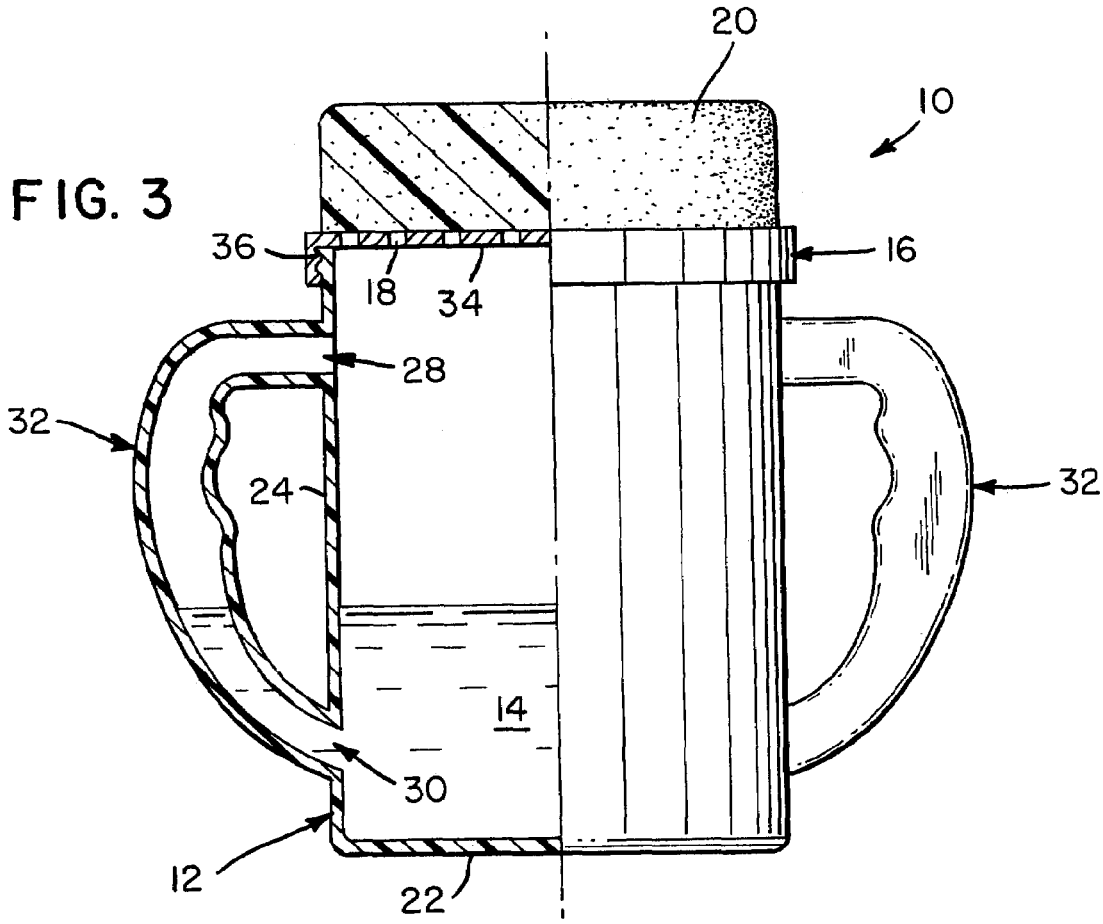
FIG. 3 is a front elevational and partial cross-sectional view of the tool.
Figure 4:
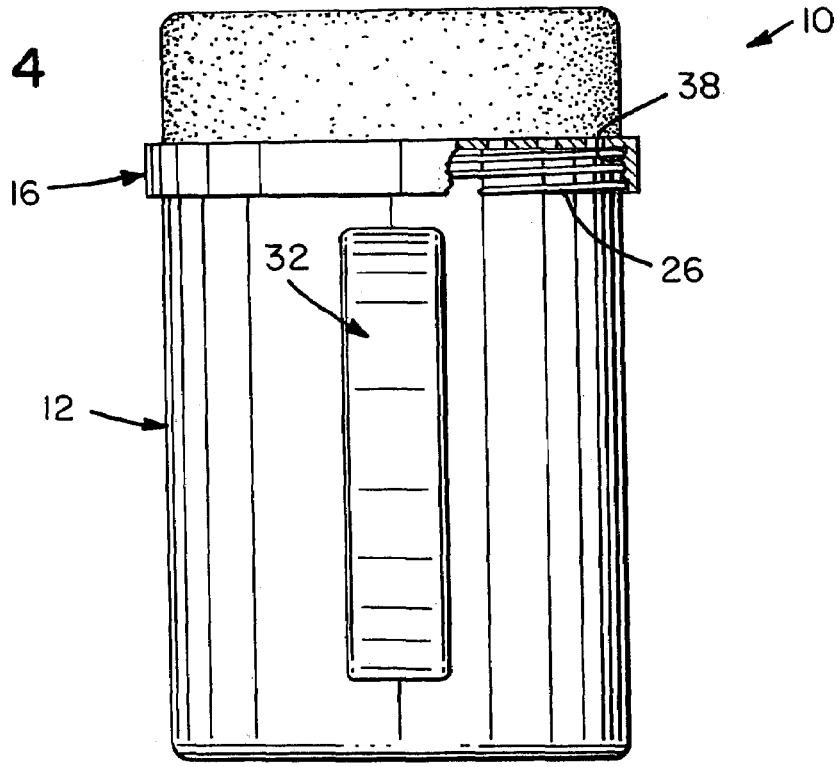
FIG. 4 is a side elevational view of the tool with portions broken away.

Referring now to the FIGS., a liquid soap dispensing and scrubbing tool is shown at 10. Tool 10 includes an open-topped container 12 for holding a predetermined quantity of liquid soap solution 14. A lid 16 is removably fastened to the top of container 12 and has a number of small openings 18 for the passage of soap solution 14 from container 12. A sponge 20 is affixed atop of lid 16 so as to cover all of openings 18. Thus, when container 12 is inverted, soap solution 14 drains through openings 18 under the influence of gravity so as to saturate sponge 20 that can, then, be used for scrubbing purposes.

Container 12 is molded, or otherwise formed, from plastic or other suitable material. During molding, container 12 is provided with a circular, bottom wall 22 from the periphery of which a cylindrical side wall 24 extends upwardly. The top of side wall 24 carries external, helical threads 26. Beneath threads 26, side wall 24 is provided with two pairs of vertically aligned openings 28, 30. The respective pairs of openings 28, 30 are located 180° apart so as to fall within a plane that bisects container 12 from top to bottom.

So that tool 10 can be easily moved around, container 12 is made to hold around sixteen fluid ounces of soap solution 14. The capacity of container 12, however, is a matter of design choice and can be increased or decreased as a manufacturer deems fit. Of course, increasing the volume of soap solution 14 that container 12 can hold increases the weight of tool 10 proportionately.

A pair of handles 32 extends from side wall 24. Each of handles 32 is C-shaped and hollow, configured somewhat like a macaroni noodle, yet sized to be easily grasped in the hand of a user. The top and bottom ends of each handle 32 are affixed to side wall 24 so as to connect each pair of vertically aligned openings 28, 30 together. Each handle 32, then, serves as an auxiliary soap solution-carrying compartment and effectively increases the capacity of container 12 without increasing the size of tool 10.

Lid 16 is molded, or otherwise formed, from plastic or other suitable material. Lid 16 has a circular, top wall 34 from the periphery of which a cylindrical, side wall 36 extends downwardly. Side wall 36 carries internal, helical threads 38 adapted to screw onto threads 26 of container 12. Positioned at spaced-apart locations about top wall 34 are openings 18 for the passage soap solution 14. By making openings 18 small in size or few in number, the flow of soap solution 14 can be set at a rate sufficient to dispense soap solution 14 evenly for the washing of an entire car.

Sponge 20 covers top wall 34 of lid 16. Sponge 20 is formed of natural or synthetic foam rubber and is permanently affixed to top wall 34 by means of a suitable adhesive like contact cement. Sponge 20 is disk-shaped so as to conform to the contours top wall 34. The thickness of sponge 20 is a matter of design choice.

Foam of the sort contemplated for use in sponge 20 is open-celled and highly porous. It is also permeable and is capable of retaining substantial quantities of liquid soap solution 14 and suspended or dissolved solids, typically greater than thirty percent of the volume of sponge 20, with which it may come into contact. Once loaded with soap solution 14, however, sponge 20 is readily compressed under minor loads to discharge the solution 14 held within its interlocked pores to regain its natural lightness. Interestingly, the pore structure of foam rubber provides a surface that gently removes dirt and grime from the surfaces of cars over which it may be rubbed.

Use of tool 10 is straightforward. First, container 12, with lid 16 removed therefrom, is filled with liquid soap solution 14. Then, lid 16 is screwed onto container 12 so that threads 26 and 38 bind snugly against one another to prevent leaks. Next, container 12 is inverted so that soap solution 14 flows from container 12 through openings 18 and into sponge 20. Now, by squeezing sponge 20 against the exterior surface of a car, soap solution 14 is dispensed to aid in lifting dirt and grime from the surface. Rubbing sponge 20 against the exterior surface of the car further assists in removing dirt and grime therefrom. Periodically, rinsing the just-rubbed surface of the car with water from a hose ensures that the car will be cleaned at the most rapid rate. When tool 10 is no longer needed, bottom wall 22 is set on a horizontal supporting surface to prevent the further discharge of soap solution from openings 18. Tool 10 is ready for immediate reuse.

While tool 10 has been described with a high degree of particularity, it will be appreciated by those skilled in the art that modifications can be made to it. For example, the openings 18 in lid 16 can be confined to one side of top wall 34 so that, if tool 10 is tipped, soap solution 18 cannot flow from container 12 unless the openings 18 are rolled below the liquid level in container 12 thereby providing a simple means to stop the flow of soap solution 14 from container 12 during the use of tool 10. Also, tool 10 need not be provided with a pair of handles 32, though preferable for pressing downwardly on sponge 20 with even pressure, but could be provided with a single handle for grasping with one hand. Therefore, it is to be understood that the present invention is not limited to the tool 10 described above, but encompasses any and all tools within the scope of the following claims.

I claim:

1. A liquid soap dispensing and scrubbing tool, comprising:

an open-topped container for holding a predetermined quantity of liquid soap solution, said container including:

a circular bottom wall;

a first, cylindrical, side wall being connected to, and extending upwardly from, said circular bottom wall, and said first, cylindrical, side wall being provided with external, helical threads at the top thereof;

a first pair of vertically aligned openings in said first, cylindrical, side wall;

a second pair of vertically aligned openings in said first, cylindrical, side wall being located in opposition to said first pair of vertically aligned openings;

a first, C-shaped, tubular handle being connected to, and extending outwardly from, said first, cylindrical, side wall, the top of said first, C-shaped, tubular handle opening to the uppermost one of said first pair of vertically aligned openings and the bottom of said first, C-shaped, tubular handle opening to said lowermost one of said first pair of vertically aligned openings so as to place said first pair of vertically aligned openings in fluid communication with one another through said first, C-shaped, tubular handle; and, a second, C-shaped, tubular handle being connected to, and extending outwardly from, said first, cylindrical, side wall, the top of said second, C-shaped, tubular handle opening to the uppermost one of said second pair of vertically aligned openings and the bottom of said second, C-shaped, tubular handle opening to said lowermost one of said second pair of vertically aligned openings so as to place said second pair of vertically aligned openings in fluid communication with one another through said second, C-shaped, tubular handle;

a lid being removably fastened to the top of said container, said lid including:

a circular, top wall, said top wall being provided with a plurality of spaced-apart openings for the passage of liquid soap solution from said container;

a second, cylindrical, side wall being connected to, and extending downwardly from, said top wall, said second, cylindrical, side wall being provided with internal, helical threads adapted to screw onto said external, helical threads of said container; and, an uncompressed sponge being affixed atop said top wall of said lid so as to cover all of said spaced-apart openings in said top wall.

* * * * *